US010386779B2

(12) United States Patent
Boettcher et al.

(10) Patent No.: US 10,386,779 B2
(45) Date of Patent: Aug. 20, 2019

(54) WASTE TONER SYSTEM OF AN ELECTROPHOTOGRAPHIC IMAGE FORMING DEVICE

(71) Applicant: LEXMARK INTERNATIONAL, INC., Lexington, KY (US)

(72) Inventors: Brian Lester Boettcher, Versailles, KY (US); Brian Scott Carpenter, Lexington, KY (US); Kerry Leland Embry, New City, NY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/825,666

(22) Filed: Nov. 29, 2017

(65) Prior Publication Data

US 2018/0329356 A1 Nov. 15, 2018

Related U.S. Application Data

(60) Provisional application No. 62/504,728, filed on May 11, 2017.

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01); *G03G 2215/0685* (2013.01); *G03G 2221/0005* (2013.01)

(58) Field of Classification Search
CPC ..... G03G 21/105; G03G 21/10; G03G 21/12; G03G 2215/0685; G03G 2215/0005
See application file for complete search history.

(56) References Cited

U.S. PATENT DOCUMENTS

| | | | | |
|---|---|---|---|---|
| 6,466,763 | B1 | 10/2002 | Campbell et al. | |
| 7,167,672 | B2 | 1/2007 | Stafford et al. | |
| 8,315,548 | B2 | 11/2012 | Gayne et al. | |
| 8,886,080 | B2 | 11/2014 | Allen et al. | |
| 9,291,947 | B1 | 3/2016 | Bacelieri et al. | |
| 2005/0220515 | A1* | 10/2005 | Wakana | G03G 21/12 399/358 |
| 2009/0060567 | A1* | 3/2009 | Mizuno | G03G 21/105 399/111 |
| 2010/0111582 | A1* | 5/2010 | Nishimura | G03G 21/12 399/360 |
| 2011/0222940 | A1* | 9/2011 | Sakuma | G03G 21/12 399/358 |

* cited by examiner

*Primary Examiner* — Joseph S Wong

(57) ABSTRACT

A waste toner system includes a rotatable photoconductive drum and a cleaner member. A first toner sump extends along a length of the photoconductive drum for receiving waste toner removed from the outer surface of the photoconductive drum by the cleaner member. A first rotatable auger extends along the first toner sump. A pass-through opening extends from the first toner sump to a second toner sump. A second rotatable auger extends along the second toner sump. The first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger.

10 Claims, 9 Drawing Sheets

WASTE TONER SYSTEM OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/504,728, filed May 11, 2017, entitled "Waste Toner System of a Replaceable Unit of an Electrophotographic Image Forming Device," the content of which is hereby incorporated by reference in its entirety.

BACKGROUND

1. Field of the Disclosure

The present disclosure relates generally to image forming devices and more particularly to a waste toner system of an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system. The toner is then fused to the media using heat and pressure to complete the print. Not all of the toner picked up by the photoconductive drum is transferred to the print media or intermediate transfer member due to inefficiencies in the image transfer process. Waste or residual toner left on the photoconductive drum after the photoconductive drum has contacted the print media or intermediate transfer member is removed by a cleaner blade in contact with the photoconductive drum before the next image is formed on the photoconductive drum in order to avoid contamination of the next image.

It is desired to move the waste toner away from the cleaner blade and the photoconductive drum in order to allow the cleaner blade to continue removing waste toner from the surface of the photoconductive drum. It is also desired to efficiently store the waste toner in a manner that prevents leakage of waste toner and that permits continued operation of the photoconductive drum.

SUMMARY

A replaceable unit for use in an electrophotographic image forming device according to one example embodiment includes a rotatable photoconductive drum and a cleaner member in contact with an outer surface of the photoconductive drum along a length of the photoconductive drum for removing waste toner from the outer surface of the photoconductive drum. A first toner sump extends along the length of the photoconductive drum and is open to a portion of the outer surface of the photoconductive drum for receiving waste toner removed from the outer surface of the photoconductive drum by the cleaner member. A second toner sump is segregated from the first toner sump and has a larger toner storage volume than the first toner sump. A pass-through opening extends from the first toner sump to the second toner sump. A first rotatable auger in the first toner sump extends along the length of the photoconductive drum. A second rotatable auger in the second toner sump extends along a length of the first auger. The second auger is parallel to the first auger. The first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger.

A waste toner system according to one example embodiment includes a rotatable photoconductive drum and a cleaner member in contact with an outer surface of the photoconductive drum along a length of the photoconductive drum for removing waste toner from the outer surface of the photoconductive drum. A first toner sump extends along the length of the photoconductive drum and is open to a portion of the outer surface of the photoconductive drum for receiving waste toner removed from the outer surface of the photoconductive drum by the cleaner member. A second toner sump is segregated from the first toner sump and has a larger toner storage volume than the first toner sump. A first rotatable auger in the first toner sump extends along the length of the photoconductive drum. A second rotatable auger in the second toner sump extends along a length of the first auger. A pass-through opening extends from the first toner sump to the second toner sump. The pass-through opening is positioned next to a first end of the first auger and an adjacent first end of the second auger. The first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger.

A waste toner system according to another example embodiment includes a rotatable photoconductive drum and a cleaner member in contact with an outer surface of the photoconductive drum along a length of the photoconductive drum for removing waste toner from the outer surface of the photoconductive drum. A first toner sump extends along the length of the photoconductive drum and is open to a portion of the outer surface of the photoconductive drum for receiving waste toner removed from the outer surface of the photoconductive drum by the cleaner member. A second toner sump is segregated from the first toner sump and has a larger toner storage volume than the first toner sump. A first rotatable auger in the first toner sump extends along the length of the photoconductive drum. A second rotatable auger in the second toner sump extends along a length of the first auger. A pass-through opening extends from the first toner sump to the second toner sump. The first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger. The second auger includes a first screw portion, a second screw portion and a screwless connecting portion that connects the first screw portion to the second screw portion. The first and second screw portions of the second auger each include a screw flight for moving waste toner along a length of the second auger upon rotation of the second auger in the operative rotational direction of the second auger.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in ear substituted for those of others. The following description, therefore, is not to be taken in a limiting sense and the scope of the present disclosure is defined only by the appended claims and their equivalents.

Figure 1:
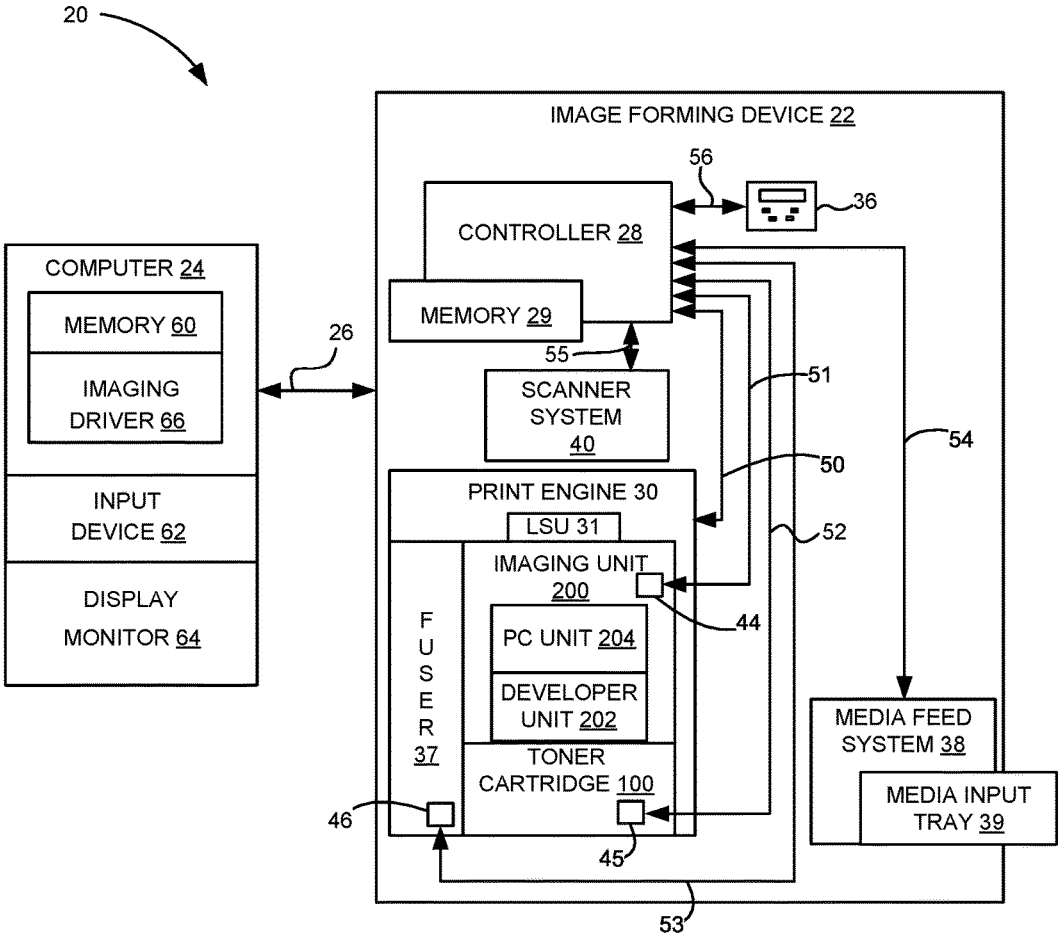
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 202 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 202 includes a developer roll that attracts the magnetic carrier beads having toner thereon to the developer roll through the use of magnetic fields. Imaging unit 200 also includes a photoconductor unit ("PC unit") 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner reservoir in developer unit 202.

The electrophotographic printing process is well known in the art and, therefore, is described briefly herein. During a printing operation, a charge roll in PC unit 204 electrically charges the outer surface of the photoconductive drum in PC unit 204 to a predetermined voltage. Laser scan unit 31 then discharges a selected portion of the outer surface of the photoconductive drum to create a latent image on the outer surface of the photoconductive drum. Toner is transferred from the toner reservoir in developer unit 202 to the latent image on the photoconductive drum by the developer roll to create a toned image on the outer surface of the photoconductive drum. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
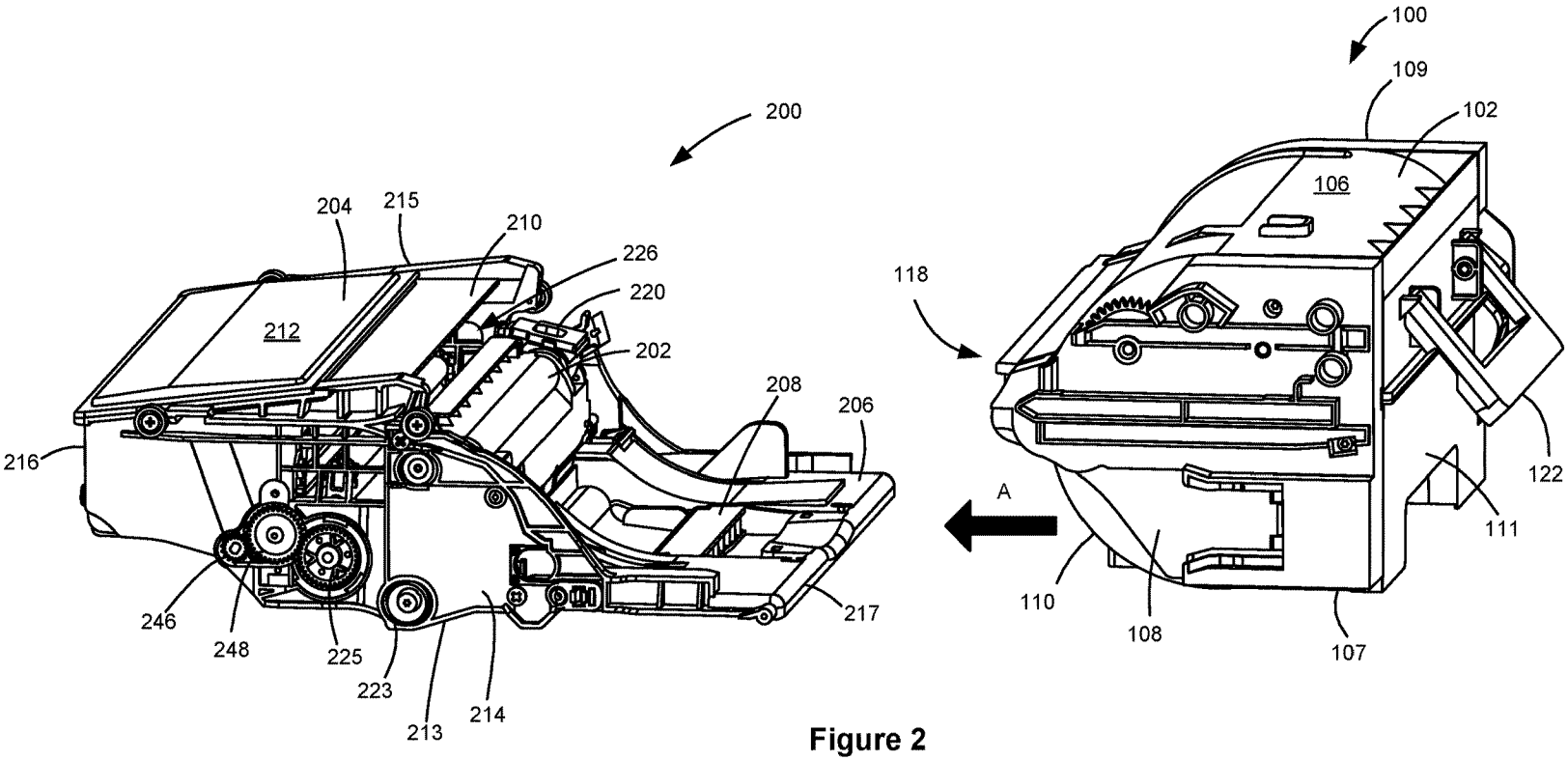
FIG. 2 is a perspective view of a toner cartridge and an imaging unit according to one example embodiment.

Referring now to FIG. 2, toner cartridge 100 and imaging unit 200 are shown according to one example embodiment. Toner cartridge 100 and imaging unit 200 are each removably installable in image forming device 22. Imaging unit 200 is first slidably inserted into image forming device 22. Toner cartridge 100 is then inserted into image forming device 22 in a mating relationship with imaging unit 200 as indicated by the arrow A shown in FIG. 2, which also indicates the direction of insertion of toner cartridge 100 and imaging unit 200 into image forming device 22. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with imaging unit 200 or to clear a media jam.

Toner cartridge 100 includes an enclosed reservoir for storing the main toner supply for image forming device 22. Toner cartridge 100 includes a top 106, a bottom 107, first and second sides 108, 109, a front 110 and a rear 111. Front 110 of toner cartridge 100 leads during insertion of toner cartridge 100 into image forming device 22 and rear 111 trails. An outlet port 118 in fluid communication with the toner reservoir of toner cartridge 100 is positioned facing downward on front 110 of toner cartridge 100 near side 109 for exiting toner from toner cartridge 100. A handle 122 may be provided on top 106 or rear 111 of toner cartridge 100 to assist with insertion and removal of toner cartridge 100 into and out of image forming device 22.

Figure 3:
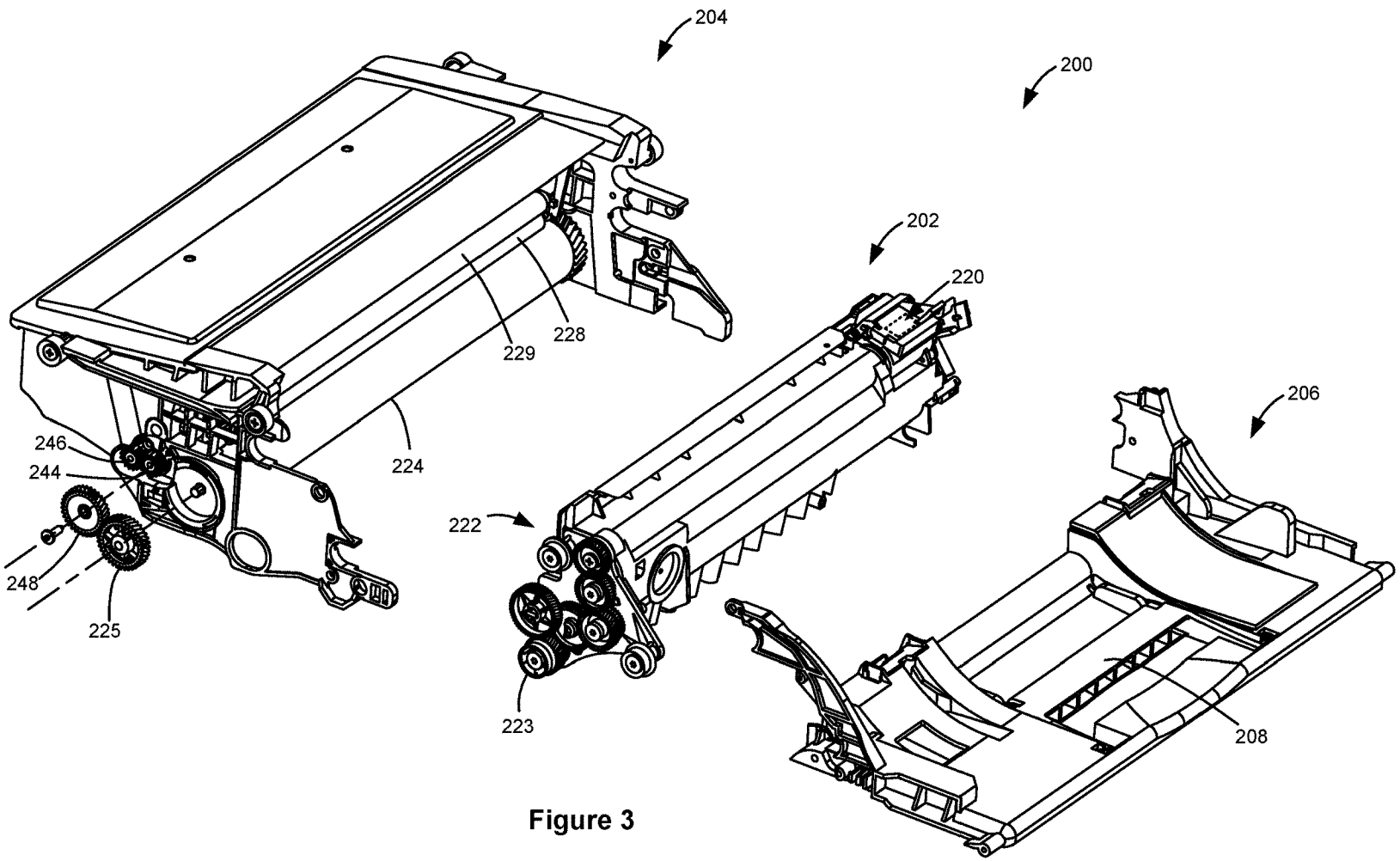
FIG. 3 is an exploded perspective view of the imaging unit shown in FIG. 2.

Imaging unit 200 is shown according to one example embodiment in FIGS. 2 and 3. In the example embodiment illustrated, imaging unit 200 includes a developer unit 202 mounted against a PC unit 204. A handle frame 206 is attached to PC unit 204. Imaging unit 200 includes a top 212, a bottom 213, first and second sides 214, 215, a front 216 and a rear 217. Front 216 of imaging unit 200 leads during insertion of imaging unit 200 into image forming device 22 and rear 217 trails. PC unit 204 is positioned at front 216 of imaging unit 200 and handle frame 206 is positioned at rear 217 of imaging unit 200. Handle frame 206 includes a handle 208 exposed on imaging unit 200 for user engagement to assist with insertion and removal of imaging unit 200 into and out of image forming device 22. Handle frame 206 may also include alignment features that aid in aligning toner cartridge 100 with imaging unit 200 during insertion of toner cartridge 100 into image forming device 22.

Developer unit 202 includes a toner inlet port 220 on top 212 of imaging unit 200 near side 215 that is positioned to receive toner from toner cartridge 100. Toner received by inlet port 220 is stored in the toner reservoir of developer unit 202. Developer unit 202 includes a rotatable developer roll 222 that is mated with a rotatable photoconductive drum ("PC drum") 224 of PC unit 204. As discussed above, developer roll 222 transfers toner from the toner reservoir in developer unit 202 to the latent image on PC drum 224 to create a toned image on the surface of PC drum 224. Developer unit 202 may also include one or more toner agitators for mixing toner stored in the toner reservoir of developer unit 202 and may further include a toner adder roll for moving toner in the toner reservoir to the outer surface of developer roll 222. In the example embodiment illustrated, developer unit 202 includes a drive coupler 223 exposed on side 214 of imaging unit 200. Drive coupler 223 mates with a corresponding drive coupler in image forming device 22 when imaging unit 200 is installed in image forming device 22 in order to receive rotational motion from an electric motor in image forming device 22. Drive coupler 223 is rotatably coupled to developer roll 222 via a drive train on developer unit 202 such that rotation of drive coupler 223 provides rotational motion to developer roll 222. Drive coupler 223 may also be rotatably coupled to other components of developer unit 202, such as a toner adder roll and/or various toner agitators of developer unit 202.

PC unit 204 includes a rotatable PC drum 224 as discussed above. A portion of the outer surface of PC drum 224 is exposed on bottom 213 of imaging unit 200. Toner on the outer surface of PC drum 224 is transferred from the portion of the outer surface of PC drum 224 that is exposed on bottom 213 of imaging unit 200 to a media sheet or intermediate transfer member during a print operation. PC unit 204 also includes a drive coupler 225 exposed on side 214 of imaging unit 200. Drive coupler 225 mates with a corresponding drive coupler in image forming device 22 when imaging unit 200 is installed in image forming device 22 in order to receive rotational motion from an electric motor in image forming device 22. Drive coupler 225 is rotatably coupled to PC drum 224 such that rotation of drive coupler 225 provides rotational motion to PC drum 224. For example, in the embodiment illustrated, drive coupler 225 is positioned on an axial end of PC drum 224. A narrow slit 226 is formed between PC unit 204 and developer unit 202 at the top 212 of imaging unit 200. Slit 226 permits a laser of laser scan unit 31 to discharge selected portions of the outer surface of PC drum 224 in order to create the latent image on the outer surface of PC drum 224.

Figure 4:
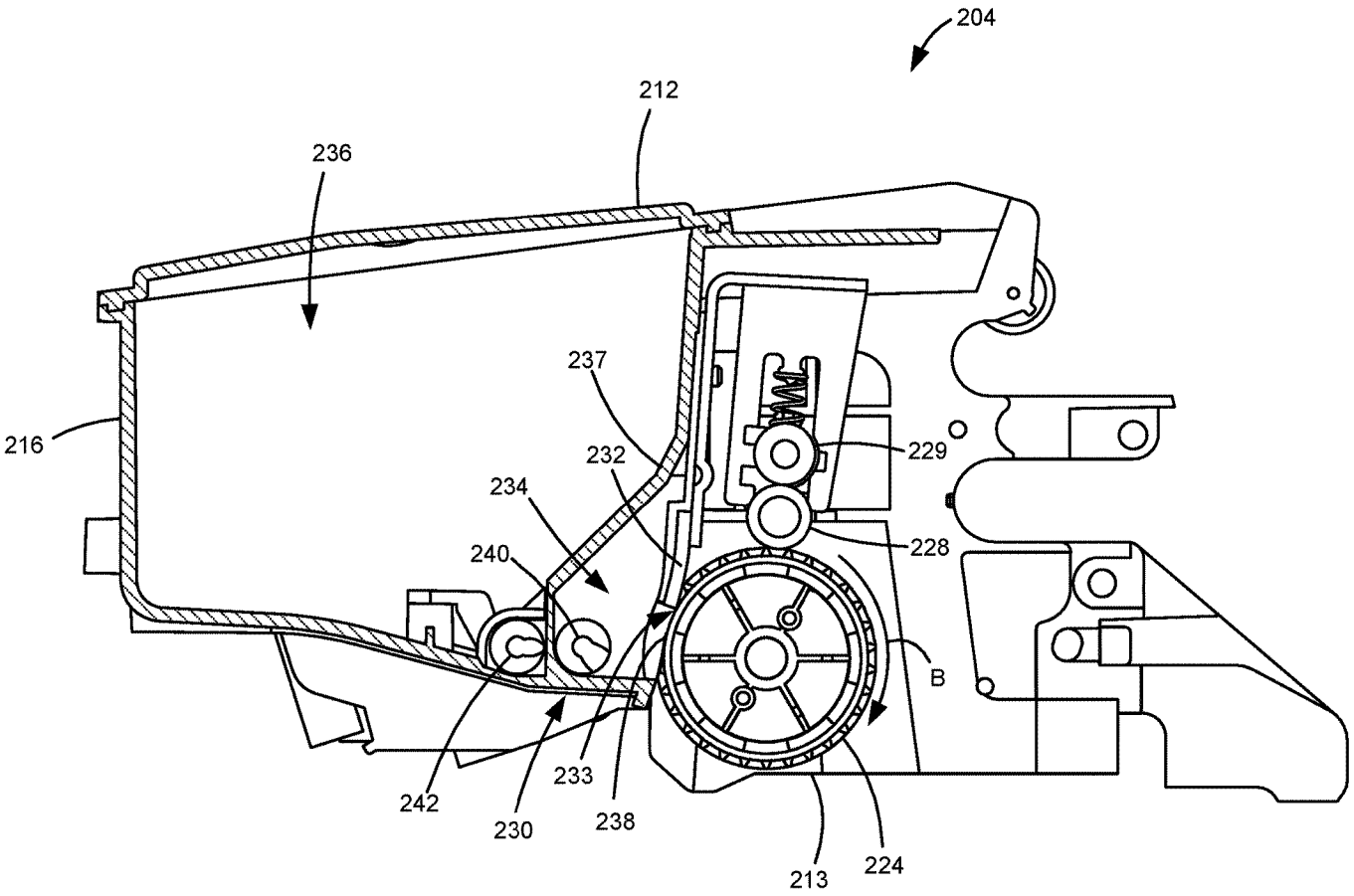
FIG. 4 is a cross-sectional side view of a photoconductor unit of the imaging unit shown in FIGS. 2 and 3 according to one example embodiment.

FIG. 4 shows a cross-sectional view of PC unit 204 illustrating internal components of PC unit 204. PC unit 204 includes a rotatable charge roll 228 in contact with the outer surface of PC drum 224 along the length of PC drum 224 that charges the outer surface of PC drum 224 to a predetermined voltage. PC unit 204 may also include a cleaner roll 229 in contact with the outer surface of charge roll 228 along the length of charge roll 228 that removes toner and other contaminants from the surface of charge roll 228.

PC unit 204 also includes a waste toner system 230 that removes residual or waste toner from the outer surface of PC drum 224 and moves the waste toner to a storage location that is isolated from PC drum 224 and the other imaging components of imaging unit 200. Waste toner system 230 includes a cleaner blade 232 (or cleaner pad or roll) in contact with the outer surface of PC drum 224 along the length of PC drum 224 that removes residual toner from the outer surface of PC drum 224. In the embodiment illustrated, waste toner system 230 includes a pair of toner sumps 234, 236 for storing toner removed from the surface of PC drum 224 by cleaner blade 232. A wall 237 segregates toner sump 234 from toner sump 236. Toner removed from the surface of PC drum 224 is collected by toner sump 234 and then moved to toner sump 236 where the waste toner is stored.

Toner sump 234 is positioned adjacent to PC drum 224 and extends the length of PC drum 224. Toner sump 234 is open to a portion of the outer surface of PC drum 224 immediately upstream (relative to an operative rotational direction of PC drum 224 indicated by the arrow B in FIG. 4) from a contact point 233 of cleaner blade 232 with the outer surface of PC drum 224 allowing toner removed from the outer surface of PC drum 224 by cleaner blade 232 to fall into and collect in toner sump 234, A lower cleaner seal 238 may be provided in contact with the outer surface of PC drum 224 along the length of PC drum 224 and spaced upstream (relative to the operative rotational direction of PC drum 224) from contact point 233 of cleaner blade 232 in order to help prevent toner from leaking out of toner sump 234 past PC drum 224.

Toner sump 236 extends the length of PC drum 224 and is positioned on an opposite side of toner sump 234 from PC drum 224. In the example embodiment illustrated, toner sump 236 is positioned at a frontmost portion of imaging unit 200. Toner sump 236 has a larger storage volume than toner sump 234 allowing toner removed from PC drum 224 to accumulate in toner sump 236 until imaging unit 200 is removed from image forming device 22 and replaced.

Waste toner system 230 includes a rotatable auger 240 positioned in toner sump 234 and a rotatable auger 242 positioned in toner sump 236. Auger 242 extends along the length of auger 240 and is positioned on an opposite side of wall 237 from auger 240. Auger 240 feeds toner cleaned from the surface of PC drum 224 and collected in toner sump 234 to auger 242, which, in turn, distributes the toner in toner sump 236 as discussed in greater detail below. In the example embodiment illustrated, augers 240, 242 are parallel to each other and to PC drum 224 and are positioned along bottom surfaces of toner sumps 234, 236, respectively. With reference back to FIG. 3, each auger 240, 242 includes a respective drive coupler 244, 246 connected to a drive end of each auger 240, 242 at side 214 of imaging unit 200. In the example embodiment illustrated, drive couplers 244, 246 are formed integrally with augers 240, 242. In other embodiments, drive couplers 244, 246 are separate components attached to augers 240, 242. In the example embodiment illustrated, drive couplers 244, 246 are rotatably connected to drive coupler 225 of PC drum 224 by way of a compound idler gear 248 that receives rotational motion from drive coupler 225 of PC drum 224 and drives drive coupler 244 of auger 240, which, in turn, drives drive coupler 246 of auger 242. In this manner, augers 240, 242 rotate with PC drum 224 upon drive coupler 225 receiving rotational motion from its corresponding drive coupler in image forming device 22 when imaging unit 200 is installed in image forming device 22. Of course, drive couplers 244, 246 may be operatively connected to each other and to drive coupler 225 by any other suitable arrangement. Further, in other embodiments, augers 240, 242 may be driven independently of PC drum 224.

Figure 5:
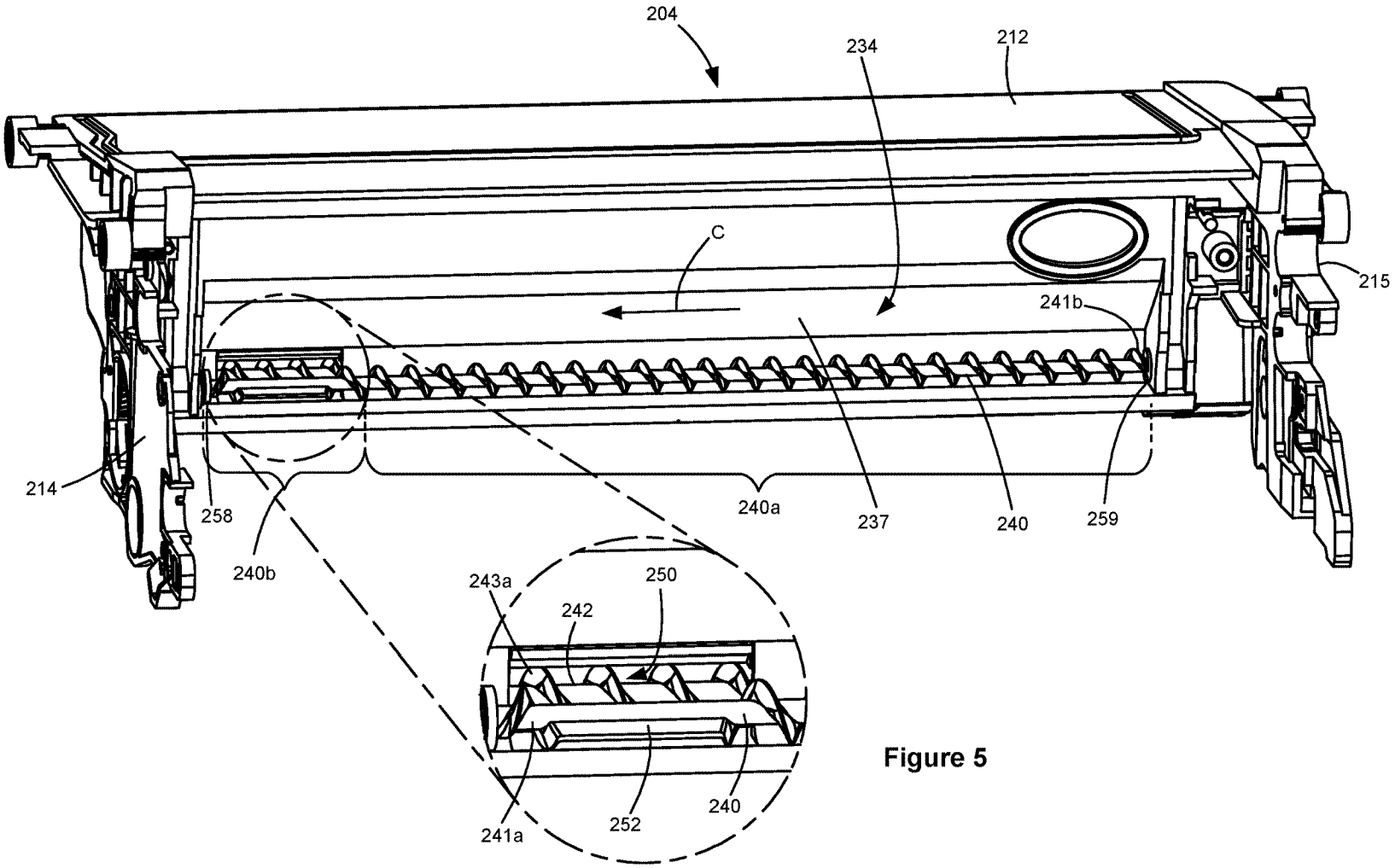
FIG. 5 is a perspective view of the photoconductor unit with various imaging components omitted in order to illustrate a first waste toner sump and a first auger according to one example embodiment.

FIG. 5 shows PC unit 204 with PC drum 224, charge roll 228 and cleaner roll 229 (and their mounting hardware), cleaner blade 232 (and its mounting hardware) and lower cleaner seal 238 omitted in order to show toner sump 234 and auger 240 in more detail according to one example embodiment. Auger 240 is configured to feed toner in toner sump 234 toward a pass-through opening 250 through wall 237 where toner passes from toner sump 234 to auger 242 of toner sump 236. Auger 240 extends the entire length of PC drum 224 in order to pick up toner cleaned from the outer surface of PC drum 224 along the entire lengths of PC drum 224 and cleaner blade 232. In the example embodiment illustrated, auger 240 includes one or more screw portions **240*a* and a plow portion 240*b*. Screw portion(s) 240*a* of auger 240 each include a screw flight that moves toner axially along the length of auger 240 toward pass-through opening 250 upon rotation of auger 240 in an operative rotational direction. Plow portion 240*b* of auger 240 is aligned along the length of auger 240 with pass-through opening 250 and includes one or more flat plows 252 that push toner away from auger 240 and into pass-through opening 250 upon rotation of auger 240**.

Figure 6:
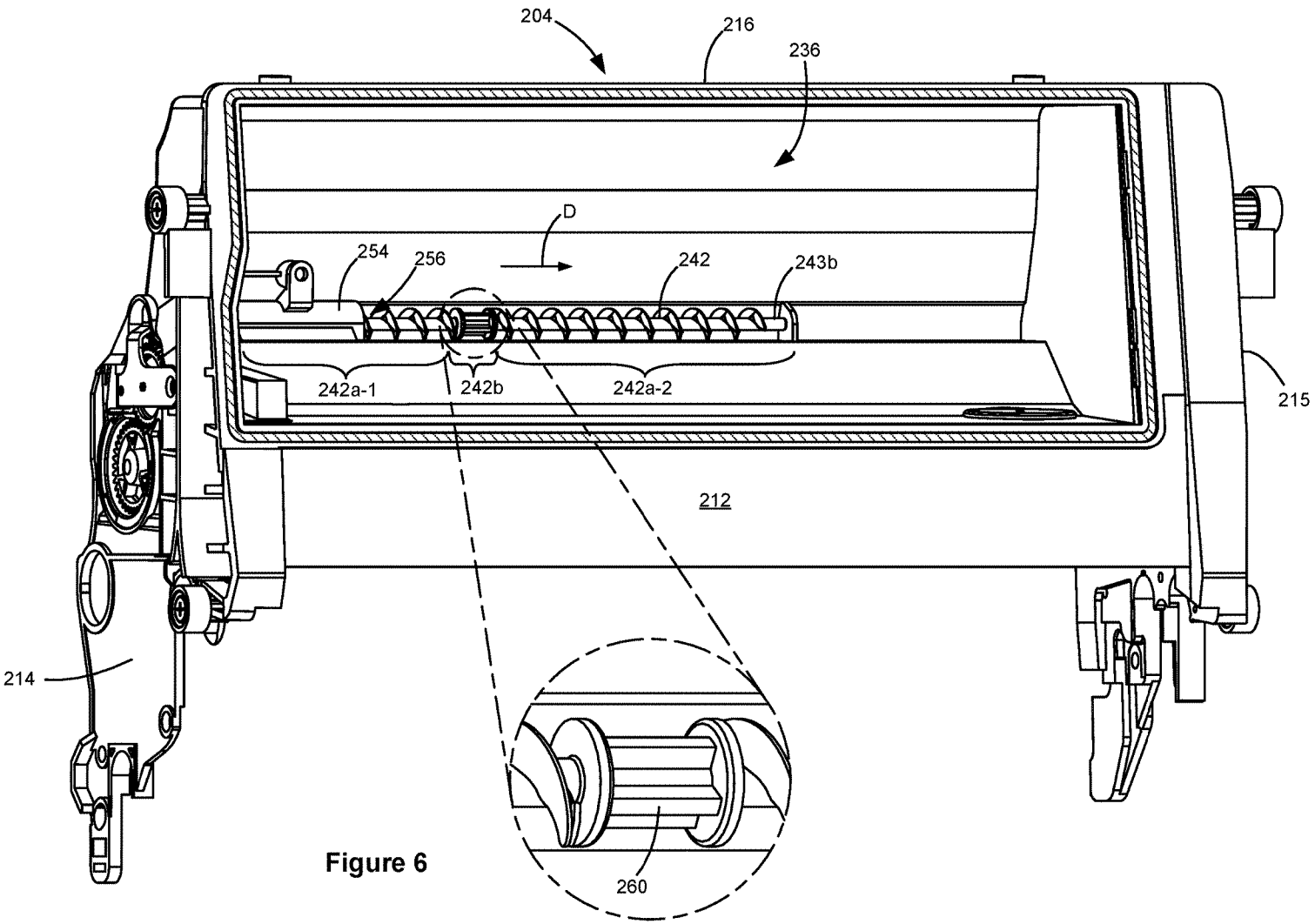
FIG. 6 is a cross-sectional view of the photoconductor unit illustrating a second waste toner sump and a second auger according to one example embodiment.

FIG. 6 shows toner sump 236 and auger 242 in more detail according to one example embodiment. Auger 242 is configured to move and distribute toner received through pass-through opening 250 from auger 240 into toner sump 236 where the toner is stored for the remainder of the life of imaging unit 200.

With reference to FIGS. 5 and 6, the ends of augers 240, 242 are each received in a respective beating that supports auger 240, 242 and facilitates rotation of auger 240, 242. For example, the ends of auger 240 are received in corresponding bearings 258, 259 (FIG. 5) at sides 214, 215 of imaging unit 200. In the example embodiment illustrated, pass-through opening 250 is positioned next to drive ends 241*a*, 243*a* of augers 240, 242. In this embodiment, the flight of screw portion 240*a* of auger 240 is angled to direct toner in toner sump 234 toward drive end 241*a* of auger 240 as indicated by the arrow C upon rotation of auger 240. In other embodiments, pass-through opening 250 may be positioned at other points along augers 240, 242, such as, for example, at a middle portion of auger 240 or next to a non-drive end 241*b* of auger 240. However, positioning pass-through opening 250 at drive ends 241*a*, 243*a* of augers 240, 242 tends to minimize the flexing or deflection of augers 240, 242 during operation because the portions of augers 240, 242 that experience the relatively large load from toner accumulating near pass-through opening 250 are positioned in close proximity to bearings supporting augers 240, 242. Positioning pass-through opening 250 at non-drive ends 241*b*, 243*b* of augers 240, 242 would tend to have the same effect but, unlike the embodiment illustrated, would require aligning non-drive ends 241*b*, 243*b* of augers 240, 242 with each other along the lengths of augers 240, 242. In contrast, in embodiments where pass-through opening 250 is positioned at a middle portion of auger 240, augers 240, 242 may be prone to deflection or bowing due to the load on augers 240, 242 near pass-through opening 250, which may necessitate a stiffer, straighter augers 240, 242 thereby increasing the cost of augers 240, 242.

With reference back to FIG. 6, in the example embodiment illustrated, toner exiting toner sump 234 through pass-through opening 250 enters an enclosed channel 254 positioned in toner sump 236. A portion of auger 242 is positioned within channel 254 to move toner from channel 254 to the relatively large reservoir of toner sump 236. In the example embodiment illustrated, a portion of auger 242 at drive end 243*a* of auger 242 is positioned within channel 254. Channel 254 is open to pass-through opening 250 to receive toner from auger 240 and also includes an open end 256 (or pair of open ends if pass-through opening 250 is positioned at a middle portion of auger 240) but is otherwise enclosed. Auger 242 extends through open end 256 of channel 254 and along the length of toner sump 236 allowing auger 242 to distribute toner in toner sump 236. The enclosure of channel 254 helps shield pass-through opening 250 in order to prevent toner stored in toner sump 236 from leaking back into toner sump 234. The enclosure of channel 254 also helps meter the toner picked up by auger 242 thereby aiding the feed of toner into toner sump 236. As shown in FIG. 6, other than the opening through enclosed channel 254 and pass-through opening 250 to auger 240, toner sump 236 is closed off from PC drum 224, e.g., by wall 237, such that the accumulation of toner in toner sump 236 does not inhibit the performance of PC drum 224.

In some embodiments, auger 242 includes one or more screw portions 242*a* and one or more connecting portions 242*b*. Screw portion(s) 242*a* of auger 242 each include a screw flight that moves toner axially along the length of auger 242 away from pass-through opening 250 upon rotation of auger 242 in an operative rotational direction. Connecting portion(s) 242*b* of auger 242, on the other hand, do not include a screw flight or other feature to move toner along the length of auger 242. Instead, in the example embodiment illustrated, each connecting portion 242*b* includes one or more connecting ribs 260 that extend axially along the length of auger 242 and join adjacent screw portions 242*a* of auger 242 to each other. In the embodiment illustrated, auger 242 includes a pair of screw portions 242*a* joined by a connecting portion 242*b*. In this embodiment, the flights of screw portions 242*a* of auger 242 are angled to direct toner in toner sump 234 away from drive end 243*a* of auger 242 as indicated by the arrow D upon rotation of auger 242 such that a first screw portion 242*a*-1 of auger 242 moves toner to connecting portion 242*b* of auger 242 and a second screw portion 242*a*-2 of auger 242 moves toner to non-drive end 243*b* of auger 242. The number of screw portions 242*a* of auger 242 dictates the number of locations along the length of auger 242 that toner accumulates and piles in toner sump 236. For example, in the embodiment illustrated, toner tends to accumulate in toner sump 236 at connecting portion 242*b* of auger 242 and at non-drive end 243*b* of auger 242 as discussed in greater detail below. In the example embodiment illustrated, connecting portion 242*b* of auger 242 is positioned at roughly one-third of the length of toner sump 236, closer to side 214 of imaging unit 200 than side 215, and non-drive end 243*b* of auger 242 is positioned at roughly one-third of the length of toner sump 236, closer to side 215 of imaging unit 200 than side 214. The positioning of connecting portion 242*b* of auger 242 and non-drive end 243*b* of auger 242 at one-third intervals provides an efficient fill of toner sump 236 along the length of toner sump 236 as discussed in greater detail below. Positioning non-drive end 243*b* of auger 242 at one-third of the length of toner sump 236 rather than at side 215 of imaging unit 200 also reduces the overall length of auger 242 thereby reducing the cost of auger 242.

Figure 7:
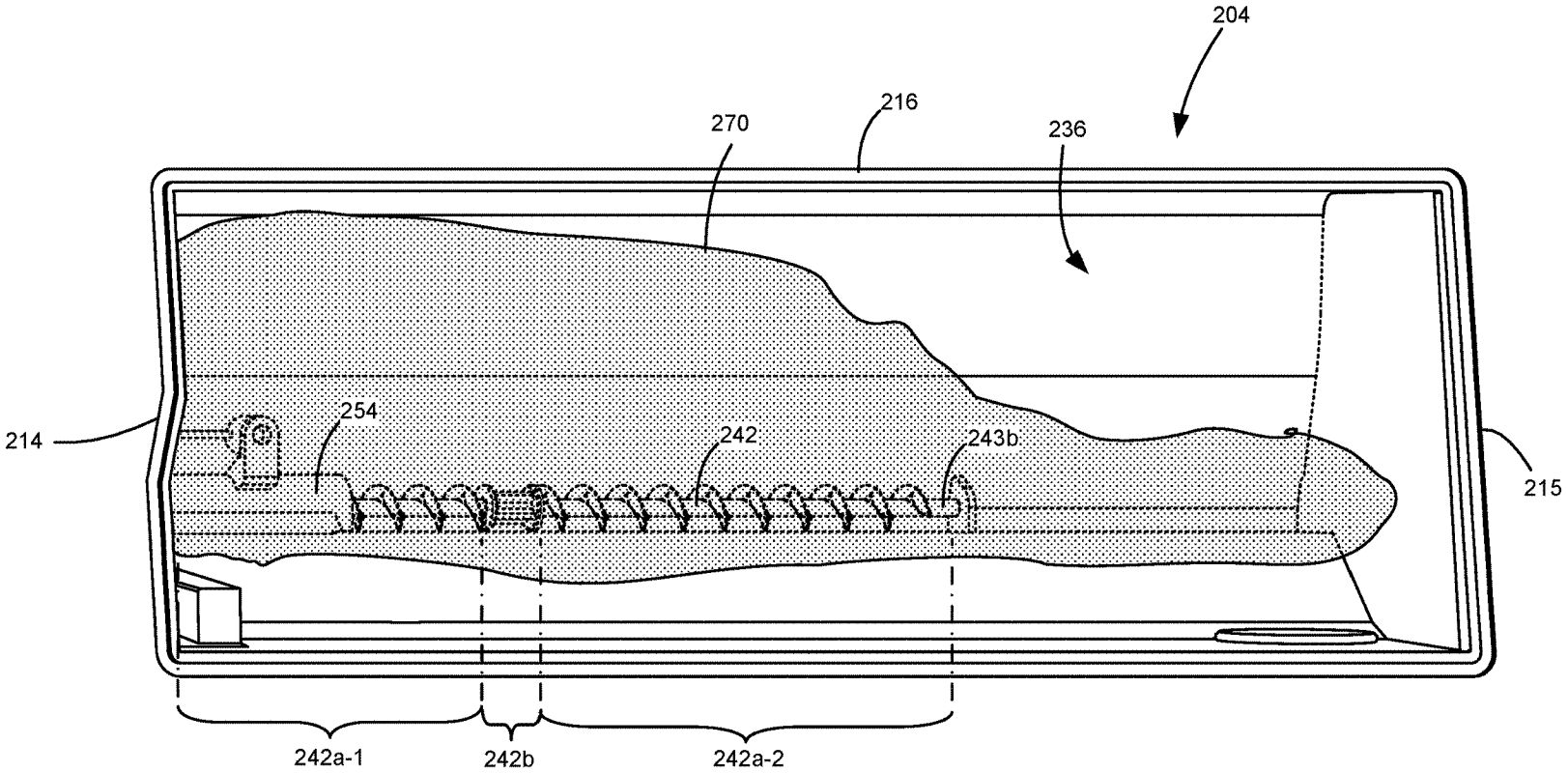
FIGS. 7-9 are sequential cross-sectional views of the photoconductor unit showing the filling of the second waste toner sump with toner according to one example embodiment.
Figure 8:
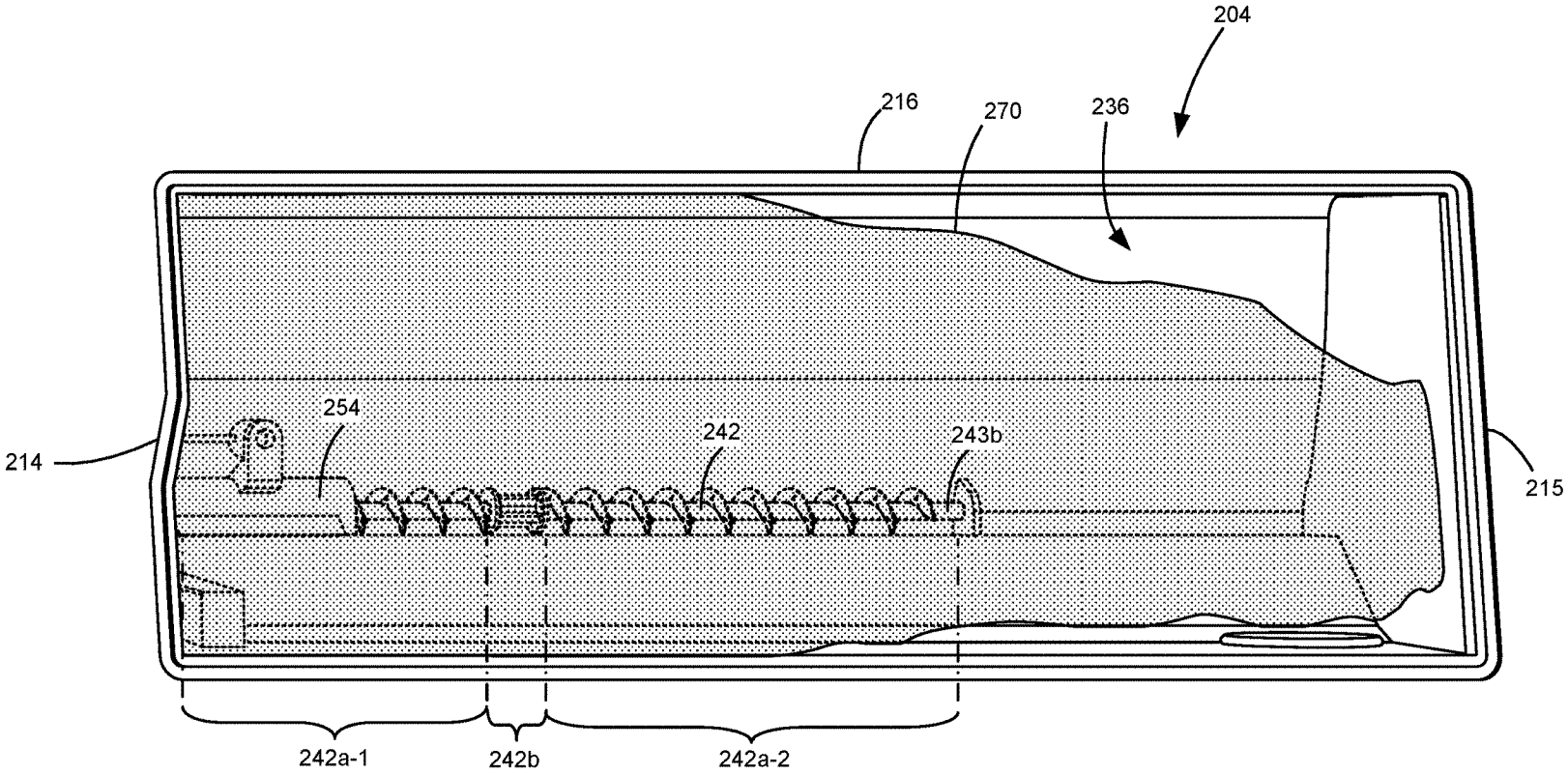
Figure 9:
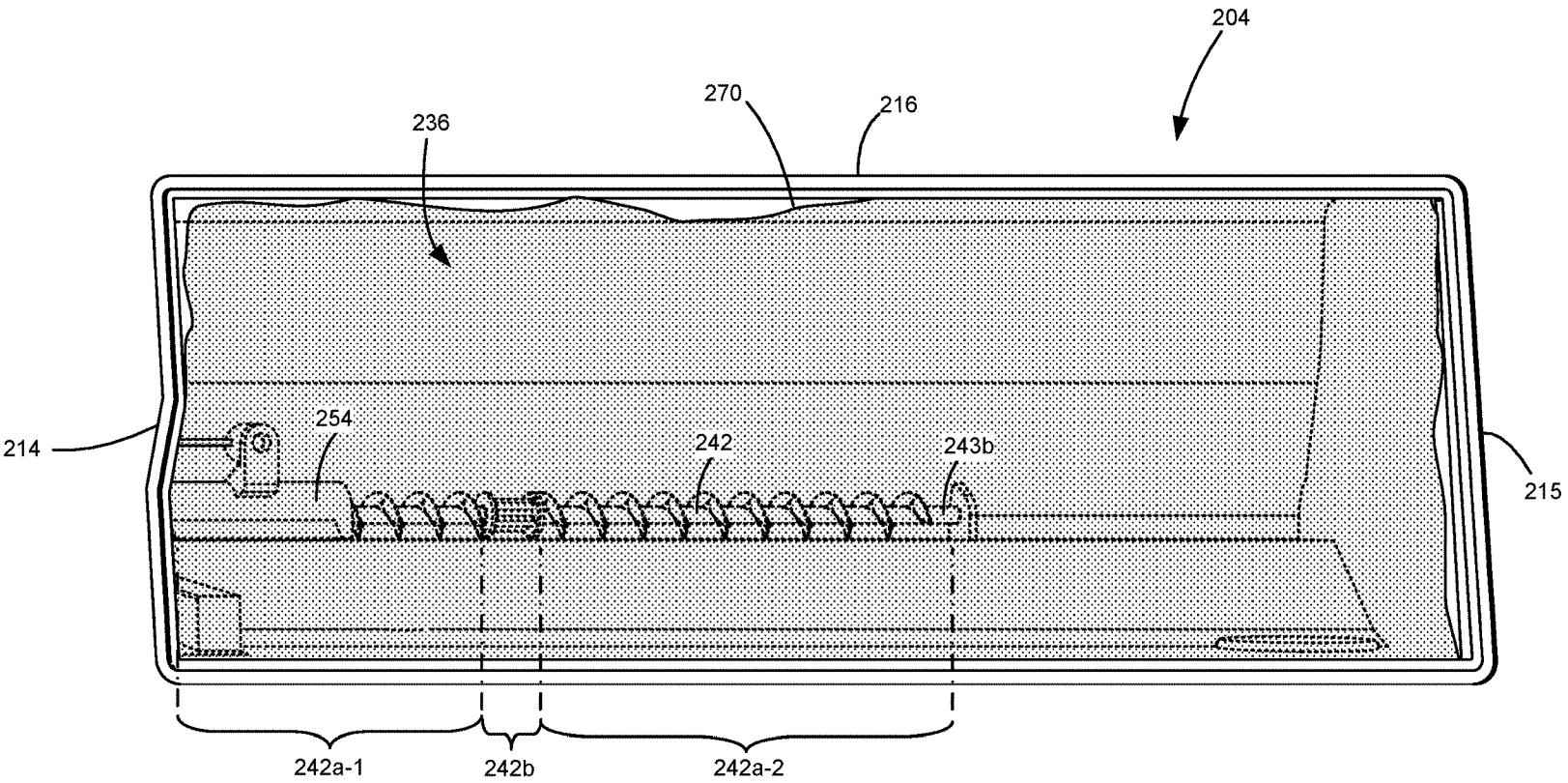

FIGS. 7-9 sequentially illustrate the filling of toner sump 236 as auger 242 receives waste toner 270 from auger 240 in toner sump 234 over time. Auger 242 and channel 254 are shown in broken line in FIGS. 7-9 since they are obscured by the toner 270 in toner sump 236. Upon rotation of auger 242, screw portion 242*a*-1 of auger 242 moves toner 270 received through pass-through opening 250 in enclosed channel 254 to the right as viewed in FIGS. 7-9 along the length of auger 242 toward connecting portion 242*b*, where toner 270 tends to accumulate since connecting portion 242*b* does not include a screw flight or other feature to move toner 270 along the length of auger 242. As toner 270 accumulates in the area of connecting portion 242*b*, toner 270 gradually piles over connecting portion 242*b* and reaches screw portion 242*a*-2 of auger 242. Screw portion 242*a*-2 of auger 242 moves toner to the right as viewed in FIGS. 7-9 along the length of auger 242 toward non-drive end 243*b* of auger 242 causing toner 270 to accumulate at non-drive end 243*b* of auger 242, For example, FIG. 7 shows toner 270 accumulating at and bridging over connecting portion 242*b* of auger 242 and toner 270 accumulating at non-drive end 243*b* of auger 242. As more waste toner 270 is delivered to toner sump 236 by auger 240, toner 270 continues to accumulate at connecting portion 242*b* of auger 242 and at non-drive end 243*b* of auger 242. Toner 270 tends to pile primarily at connecting portion 242*b* of auger 242 and secondarily at non-drive end 243*b* of auger 242 because screw portion 242*a*-2 of auger 242 tends to move some of the toner 270 accumulating at connecting portion 242*b* away from connecting portion 242*b* and toward non-drive end 243*b* of auger 242. In this manner, toner sump 236 tends to gradually fill in a controlled manner from left to right as viewed in FIGS. 7-9. For example, FIGS. 7 and 8 show toner 270 accumulating more heavily at the left side of toner sump 236, near connecting portion 242*b* of auger 242, than at the right side of toner sump 236, near non-drive end 243*b* of auger 242. The controlled fill of toner sump 236 provided by the positioning of connecting portion 242*b* of auger 242 and non-drive end 243*b* of auger 242 at one-third intervals along the length of toner sump 236 helps toner sump 236 fill more uniformly such that nearly the entire volume of toner sump 236 is occupied by toner 270 when toner sump 236 reaches a full state. For example, FIG. 9 shows toner sump 236 in a nearly full state with toner 270 distributed efficiently throughout the volume of toner sump 236.

While the example embodiment illustrated includes the accumulation of waste toner at two points along auger 242, it will be appreciated that the location and number of toner accumulation points may be selected as desired in order to optimize the fill of toner sump 236 for a given waste toner system 230. For example, an end of auger 242, such as the non-drive end 243*b*, may be positioned as desired relative to one or more connecting portions 242*b* of auger 242 that do not include a screw flight in order to cause toner to accumulate as desired.

Although the example embodiment shown in FIG. 2 includes a pair of replaceable units in the form of toner cartridge 100 and imaging unit 200, it will be appreciated that the replaceable unit(s) of image forming device 22 may employ any suitable configuration as desired. For example, in one embodiment, the main toner supply for image forming device 22, developer unit 202, and PC unit 204 are housed in one replaceable unit. In another embodiment, the main toner supply for image forming device 22 and developer unit 202 are provided in a first replaceable unit and PC unit 204 is provided in a second replaceable unit. Further, although the example image forming device 22 discussed above includes one toner cartridge 100 and corresponding imaging unit 200, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for use in an electrophotographic image forming device, comprising:

a rotatable photoconductive drum;

a cleaner member in contact with an outer surface of the photoconductive drum along a length of the photoconductive drum for removing waste toner from the outer surface of the photoconductive drum;

a first toner sump extending along the length of the photoconductive drum and open to a portion of the outer surface of the photoconductive drum for receiving waste toner removed from the outer surface of the photoconductive drum by the cleaner member;

a second toner sump segregated from the first toner sump and having a larger toner storage volume than the first toner sump;

a pass-through opening from the first toner sump to the second toner sump;

a first rotatable auger in the first toner sump extending along the length of the photoconductive drum; and a second rotatable auger in the second toner sump extending along a length of the first auger, the second auger is parallel to the first auger, wherein the first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger, wherein the second auger includes a first screw portion, a second screw portion and a screwless connecting portion that connects the first screw portion to the second screw portion, wherein the first and second screw portions of the second auger each include a screw flight for moving waste toner along a length of the second auger away from the pass-through opening upon rotation of the second auger in the operative rotational direction of the second auger, wherein the pass-through opening is positioned next to a first end of the first auger and an adjacent first end of the second auger, wherein the connecting portion of the second auger is spaced from a first end of the second toner sump and positioned closer to the first end of the second toner sump than to a second end of the second toner sump along the length of the second auger, wherein a second end of the second auger is spaced from the second end of the second toner sump and positioned closer to the second end of the second toner sump than to the first end of the second toner sump.

2. The replaceable unit of claim 1, wherein the second toner sump is positioned on an opposite side of the first toner sump from the photoconductive drum.

3. The replaceable unit of claim 1, further comprising a first drive coupler connected to the first end of the first auger and a second drive coupler connected to the first end of the second auger, the first and second drive couplers are each positioned to receive rotational motion to rotate the first and second augers in the respective operative rotational directions of the first and second augers.

4. The replaceable unit of claim 1, wherein the first auger is positioned along a bottom surface of the first toner sump and the second auger is positioned along a bottom surface of the second toner sump.

5. The replaceable unit of claim 1, wherein the first auger includes a screw portion and a plow portion, the screw portion of the first auger includes a screw flight for moving waste toner along the length of the first auger toward the pass-through opening upon rotation of the first auger in the operative rotational direction of the first auger, the plow portion is aligned along the length of the first auger with the pass-through opening and includes a plow that is positioned to push toner away from the first auger and into the pass-through opening upon rotation of the first auger in the operative rotational direction of the first auger.

6. A waste toner system, comprising:

a rotatable photoconductive drum;

a cleaner member in contact with an outer surface of the photoconductive drum along a length of the photoconductive drum for removing waste toner from the outer surface of the photoconductive drum;

a first toner sump extending along the length of the photoconductive drum and open to a portion of the outer surface of the photoconductive drum for receiving waste toner removed from the outer surface of the photoconductive drum by the cleaner member;

a second toner sump segregated from the first toner sump and having a larger toner storage volume than the first toner sump;

a first rotatable auger in the first toner sump extending along the length of the photoconductive drum;

a second rotatable auger in the second toner sump extending along a length of the first auger; and a pass-through opening from the first toner sump to the second toner sump, the pass-through opening is positioned next to a first end of the first auger and an adjacent first end of the second auger, wherein the first auger is positioned to move waste toner in the first toner sump to the pass-through opening upon rotation of the first auger in an operative rotational direction of the first auger and the second auger is positioned to distribute waste toner received through the pass-through opening into the second toner sump upon rotation of the second auger in an operative rotational direction of the second auger, wherein the second auger includes a first screw portion, a second screw portion and a screwless connecting portion that connects the first screw portion to the second screw portion, wherein the first and second screw portions of the second auger each include a screw flight for moving waste toner along a length of the second auger away from the pass-through opening upon rotation of the second auger in the operative rotational direction of the second auger, wherein the connecting portion of the second auger is spaced from a first end of the second toner sump and positioned closer to the first end of the second toner sump than to a second end of the second toner sump along the length of the second auger, wherein a second end of the second auger is spaced from the second end of the second toner sump and positioned closer to the second end of the second toner sump than to the first end of the second toner sump.

7. The waste toner system of claim 6, wherein the second toner sump is positioned on an opposite side of the first toner sump from the photoconductive drum.

8. The waste toner system of claim 6, further comprising a first drive coupler connected to the first end of the first auger and a second drive coupler connected to the first end of the second auger, the first and second drive couplers are each positioned to receive rotational motion to rotate the first and second augers in the respective operative rotational directions of the first and second augers.

9. The waste toner system of claim 6, wherein the first auger is positioned along a bottom surface of the first toner sump and the second auger is positioned along a bottom surface of the second toner sump.

10. The waste toner system of claim 6, wherein the first auger includes a screw portion and a plow portion, the screw portion of the first auger includes a screw flight for moving waste toner along the length of the first auger toward the pass-through opening upon rotation of the first auger in the operative rotational direction of the first auger, the plow portion is aligned along the length of the first auger with the pass-through opening and includes a plow that is positioned to push toner away from the first auger and into the pass-through opening upon rotation of the first auger in the operative rotational direction of the first auger.

* * * * *